US006227176B1

(12) United States Patent
Hettmann

(10) Patent No.: US 6,227,176 B1
(45) Date of Patent: May 8, 2001

(54) PRESSURE EQUALIZATION SYSTEM FOR A FUEL TANK OF AN INTERNAL COMBUSTION ENGINE

(75) Inventor: Heinz Hettmann, Schorndorf (DE)

(73) Assignee: Andreas Stihl AG & Co., Waiblingen (DE)

( * ) Notice: Subject to any disclaimer, the term of this patent is extended or adjusted under 35 U.S.C. 154(b) by 0 days.

(21) Appl. No.: 09/353,011

(22) Filed: Jul. 13, 1999

(30) Foreign Application Priority Data

Jul. 16, 1998 (DE) ..... 298 12 679 U

(51) Int. Cl.[7] ..... F02M 37/04
(52) U.S. Cl. ..... 123/516; 261/36.2
(58) Field of Search ..... 123/516, 518, 123/514; 261/35, 72.1, DIG. 68, 36.2

(56) References Cited

U.S. PATENT DOCUMENTS

| | | | | |
|---|---|---|---|---|
| 3,610,221 | * | 10/1971 | Stoltman | 123/136 |
| 4,824,613 | | 4/1989 | Scott et al. | 261/35 |
| 5,063,891 | * | 11/1991 | Noisier | 123/187.5 R |
| 5,429,776 | * | 7/1995 | Edlund | 261/35 |
| 5,526,843 | | 6/1996 | Wolf et al. | 137/550 |
| 5,676,115 | | 10/1997 | Linsbauer et al. | 123/516 |
| 5,743,240 | | 4/1998 | Zerrer et al. | 123/518 |

FOREIGN PATENT DOCUMENTS

| | | |
|---|---|---|
| 0688948 | 12/1995 | (EP) . |
| 2310007 | 8/1997 | (GB) . |

* cited by examiner

*Primary Examiner*—Henry C. Yuen
*Assistant Examiner*—Mahmoud M Gimie
(74) *Attorney, Agent, or Firm*—Walter Ottesen

(57) ABSTRACT

A pressure equalization system serves to prevent an undesired pressure level in a fuel tank of an internal combustion engine. An air/fuel mixture is fed to the internal combustion engine via the carburetor. The carburetor is, on one hand, connected to the clean air side of an intake air filter via an intake channel and, on the other hand, inducts fuel from a control chamber filled with fuel. This fuel flows from a fuel tank via an inlet valve into the control chamber, with the inlet valve being controlled by a control membrane. A start-assist device includes an intake line connected to the control chamber and a return line connected to the fuel tank. A pressure equalization valve connected to the return line of the start-assist device is provided for the fuel tank, with the pressure equalization valve also being connected to the intake channel.

11 Claims, 2 Drawing Sheets

PRESSURE EQUALIZATION SYSTEM FOR A FUEL TANK OF AN INTERNAL COMBUSTION ENGINE

FIELD OF THE INVENTION

The invention relates to a pressure equalization system for a fuel tank of an internal combustion engine, in particular for handheld portable tools such as cutoff machines, chain saws and the like.

BACKGROUND OF THE INVENTION

A carburetor for an internal combustion engine in a tool, namely a chain saw, is known from EP 0 688 948 A2. The air required for combustion is inducted from the ambient air through an intake channel via an intake air filter while the fuel to be mixed with the air is supplied from a fuel tank via a carburetor. The carburetor has a control chamber which is delimited by a membrane and filled with fuel. On one hand, the membrane controls an inlet valve in the control chamber and, on the other hand, delimits a compensation chamber which lies on the dry side of the control membrane. A fuel pump is provided in the carburetor housing to move the fuel to the control chamber. From the control chamber, the fuel passes to nozzles through which the fuel enters the intake channel.

In addition, a start-assist device for the internal combustion engine is also provided in the known arrangement. This start-assist device removes the vapor bubbles which develop in the carburetor while the engine is at standstill. The vapor bubbles would otherwise prevent the internal combustion engine from starting at a subsequent attempt. This start-assist device, which is connected between the control chamber and the fuel tank, serves to flood the fuel system. Subsequent start attempts are then made with a filled fuel system which ensures that the internal combustion engine will start quickly with few attempts.

In such tools, the fuel tank is hermetically sealed in order to avoid leaks whatever the work position of the tool. The consumption of fuel due to the operation of the internal combustion engine leads to the formation of underpressure in the fuel tank. This can lead to a strong decrease in fuel volume such that malfunctions occur in the carburetor to be fed or in the internal combustion engine supplied by the carburetor.

A device is known from U.S. Pat. No. 5,526,843 which enables aeration, with the aeration valve being located at an additional opening provided in the fuel tank. A venting valve can also be arranged on the fuel tank to reduce any overpressure developed by heat. Such devices, in which the aeration and venting valves are in direct connection with the atmosphere, are known as "open systems".

A "closed system" for the aeration and venting of a fuel tank is described in U.S. Pat. No. 5,743,240. This system is based on the arrangement of a pressure equalization line together with an aeration and a venting valve between the intake channel and an equalizing vessel connected to the fuel tank itself. The connection of the pressure equalization line to the intake channel or a compensation channel connected to the compensation chamber, forms a closed system. If the tool is used correctly, this system largely prevents the escape of any fuel into the atmosphere.

SUMMARY OF THE INVENTION

The invention is based on the object to provide a pressure equalization system with which an undesired pressure level in the fuel tank can be prevented at minimal effort and cost.

The pressure equalization system of the invention is for a fuel tank of an internal combustion engine for a portable handheld work tool such as a cutoff machine, motor-driven chain saw, brushcutter and the like. The pressure equalization system includes: a carburetor for supplying an air/fuel mixture to the engine; an intake air filter having a clean air side; the carburetor including a control membrane delimiting a control chamber filled with fuel and an intake channel into which fuel from the control chamber is drawn by suction; the intake channel being connected to the clean air side of the intake air filter; a fuel tank; a feed valve controlled by the control membrane for supplying fuel from the fuel tank to the control chamber; and, a start-assist device for flooding the control chamber before starting the engine; a suction line connecting the start-assist device to the control chamber; a return line connecting the start-assist device to the fuel tank; a pressure equalization valve connected to the return line; and, the pressure equalization valve being operatively connected to the intake channel.

The start-assist device includes, preferably, a starter pump with a combination valve which is connected to the control chamber via the suction line and to the fuel tank via the return line. The manual or automated actuation of the starter pump when the internal combustion engine is started circulates fuel together with the vapor bubbles or trapped air which form in the fuel while the internal combustion engine is at standstill. This fluid mixture of fuel, vapor bubbles and/or air is pumped through the suction line and the return line to the fuel tank. This forces the flooding of the control chamber with liquid fuel and guarantees a sufficient volume of fuel to start the internal combustion engine via idle nozzles. The arrangement of a pressure equalization valve connected to the return line between the start-assist device and the fuel tank avoids the need for an additional connection to the tank. The pressure equalization valve preferably comprises a duckbill valve for aeration and a mushroom-shaped valve head with a flexible sealing edge lying on a valve seat for venting.

When the engine is running, an underpressure builds up in the fuel tank due to the withdrawal of fuel therefrom. Since the pressure equalization valve is configured for aeration, for example, in the form of a duckbill valve, an underpressure can be avoided by means of inflowing air. This air is taken in from the clean air side of the air filter via the pressure equalization line, thus ensuring that no dirt can enter the fuel.

In a further embodiment of the invention, the pressure equalization valve is also designed to vent air from the fuel tank. If an overpressure builds up in the fuel tank, the pressure lifts the sealing edge from the valve seat and the fuel-enriched vapors can be fed directly to the clean air side of the intake air filter via the pressure equalization line. Since the venting opening is not cleared by the sealing edge until a certain threshold value in the fuel tank is exceeded, no fuel flows out of the control chamber through the aeration system while the start-assist device is pumping since the pressure built up during this phase lies below the threshold value. However, the pressure equalization valve does allow the escape of air, with fuel vapors where present, at a predetermined pressure increase in the tank. Even if a small volume of fuel escapes through the equalization valve into the pressure equalization line during the process, there is no disadvantageous effect on the operating performance since, when the fuel enters the intake channel and the air filter box, it is absorbed by inflowing combustion air and carried through the carburetor venturi to the internal combustion engine.

There is no need for a further connection to the fuel tank because an existing line is used as a connection for the aeration and venting system of the fuel tank. In this way, the tank ventilation system can be positioned in a protected position well adapted to the tool. This makes a space-saving position near the diaphragm carburetor and the fuel tank possible and also results in lower manufacturing costs.

BRIEF DESCRIPTION OF THE DRAWINGS

The invention will now be described with reference to the drawings wherein.

DESCRIPTION OF THE PREFERRED EMBODIMENTS OF THE INVENTION

Figure 1:
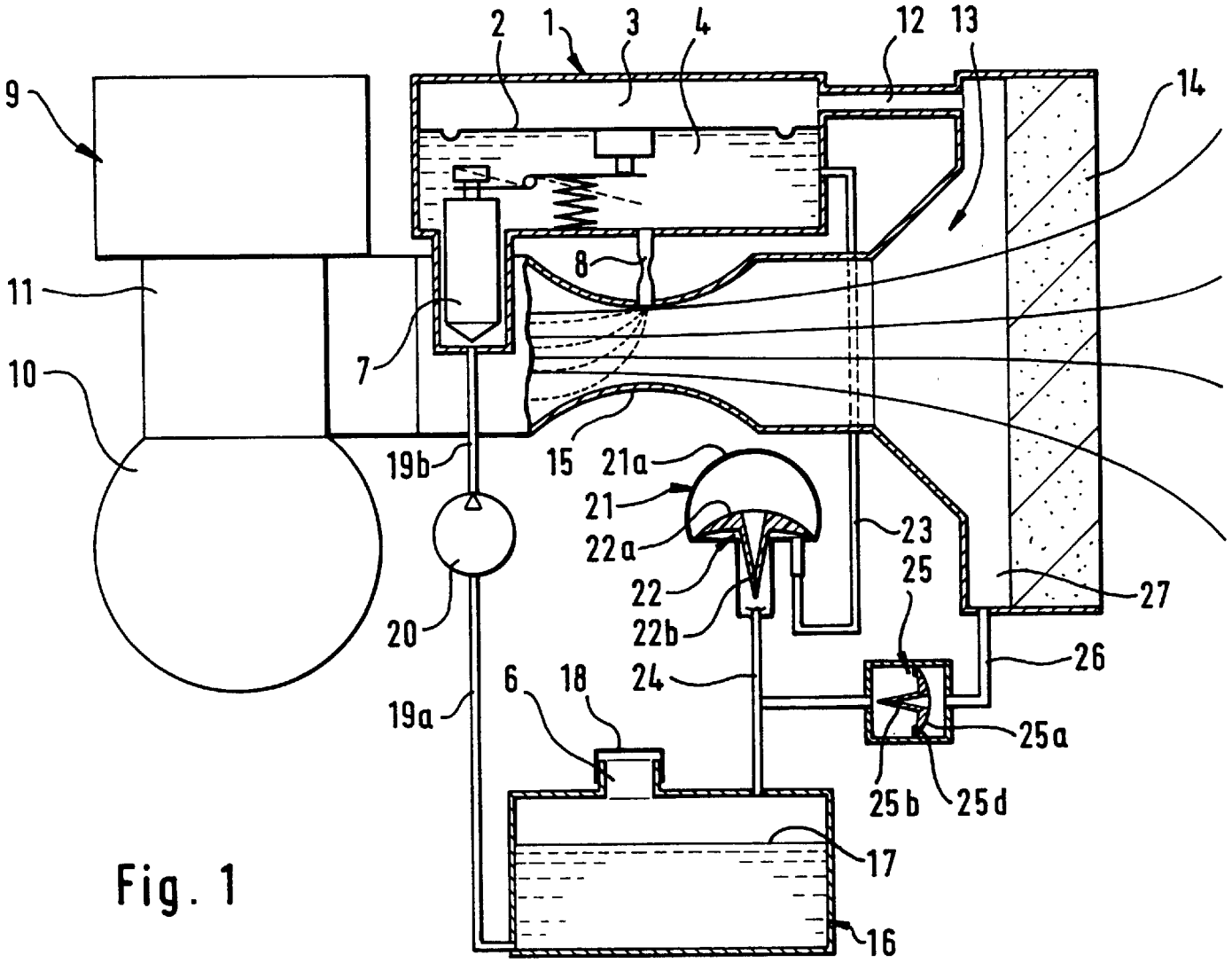
FIG. 1 shows a schematic representation of a fuel supply system with a membrane carburetor for an internal combustion engine; and, FIGS. 1*a,* 1*b* and 1*c* show different embodiments of a valve in a venting line of the fuel supply system of FIG. 1.

The fuel supply system illustrated in FIG. 1 (with the valve alternatives shown in FIGS. 1*a,* 1*b* and 1*c*) essentially comprises a membrane carburetor 1 for an internal combustion engine 9, an intake channel 13, a fuel tank 16 and a start-assist device 21. The fuel tank 16 has a fill opening 6 with a tank cap 18. The internal combustion engine 9 consists of a crankcase 10 having a cylinder 11 to which an air/fuel mixture can be fed via an intake channel 13 to operate the internal combustion engine 9. The air/fuel mixture is formed in the membrane carburetor 1 which, on one hand, takes in combustion air via an intake air filter 14 and to which, on the other hand, fuel is fed from a control chamber 4 via nozzles, of which only one main fuel nozzle 8 is shown in the venturi section 15. The fuel entering the intake channel 13 mixes with the air in the channel. The fuel is fed from the fuel tank 16 via an inlet valve 7 to the control chamber 4.

A fuel pump 20 is provided to pump the fuel. The intake connection of the fuel pump 20 is connected to the fuel tank 16 via a fuel line 19*a.* The pressure connection to the fuel pump 20 is connected to the inlet valve 7 via a fuel line 19*b.* The inlet valve 7 is controlled by a control membrane 2 which delimits the control chamber 4.

On its dry side, the control membrane 2 also delimits a compensation chamber 3 which is connected via a compensation channel 12 to the equalization portion of intake channel 13 between the carburetor 1 and the intake air filter 14, that is, the clean air side 27 thereof. This means that the underpressure which increases on the clean air side 27 as the dirt in the air filter 14 increases is also present in the compensation chamber 3, thereby increasing the underpressure required to open the inlet valve 7 in the control chamber 4. In this manner, the volume of air which decreases as the air filter becomes increasingly dirty is equalized by a corresponding reduction in the supply of fuel, that is, the air/fuel mixture remains unchanged.

The fuel tank 16 is connected to a start-assist device 21 via a return line 24 and to the control chamber 4 of the membrane carburetor 1 via an intake line 23. The start-assist device 21 comprises a combination valve 22 consisting, namely, of a duck-bill valve 22*b* and a mushroom valve 22*a.*

Before starting the tool, the control chamber 4 is flooded by means of the start-assist device 21. For this purpose, pressure is repeatedly exerted upon an elastic membrane cover 21*a,* which has the size of a finger, on the start-assist device 21. When the membrane cover 21*a* is emptied, the fuel under the cover, including the vapor bubbles or trapped air contained therein, is fed to the fuel tank 16 via the duck-bill valve 22*b* of the combination valve 22 via the return line 24. With the automatic return of the cover 21*a,* an underpressure develops in the space delimited by the cover. This leads, on one hand, to the closure of the passage at the end of the duck-bill valve 22*b* facing the return line 24 and, on the other hand, to the opening of intake line 23 which is otherwise closed by the mushroom valve 22*a* of the combination valve 22. In this way, air/fuel mixture is inducted from the control chamber 4 via the intake line 23.

A pressure equalization valve 25 in the manner of a combined mushroom/duck-bill valve 25*a*/25*b* for venting and aerating the fuel tank 16 is arranged in a joint valve housing. The mushroom valve 25*a* has a flexible sealing edge 25*d* which lies on the valve seat when the mushroom valve is in the closed position. The pressure equalization valve 25 is connected, on one hand, to the return line 24 of the start-assist device 21 and, on the other hand, via a venting line 26 to the intake channel 13 on the clean air side 27 of the intake air filter 14.

When the tool is in continuous operation fuel from the tank 16 is consumed. Because the fuel tank 16 is hermetically sealed, a reduction in the volume of fuel (indicated in FIG. 1 by fuel level 17) is associated with a simultaneous drop of the pressure in the fuel tank 16. In order to avoid malfunctions in the internal combustion engine 9 due to an insufficient supply of fuel, air, preferably at atmospheric pressure, is resupplied. This is effected by means of the pressure equalization valve 25 because the end of the duckbill valve 25*b* facing the return line 24 is opened by the underpressure and air is supplied via the venting line 26.

If the ambient air heats up considerably, part of the fuel contained in the fuel tank 16 evaporates, leading to an increase in pressure in the fuel tank 16. When a predetermined threshold value for the overpressure is reached, the flexible sealing edge 25*d* of the mushroom valve 25*a* lifts away from the valve seat and clears the venting line 26 so that the overpressure can reduce to the intake channel 13. To ensure that the pressure is reduced primarily by the escape of the flow of air, the connection of the return line 24 to the fuel tank 16 is provided at the wall above the fuel level 17. On this wall, there is also a fill opening 6 for the fuel and a tank cap 18.

The embodiments of the valves illustrated in FIGS. 1*a,* 1*b* and 1*c* are explained below.

Figure 1A:
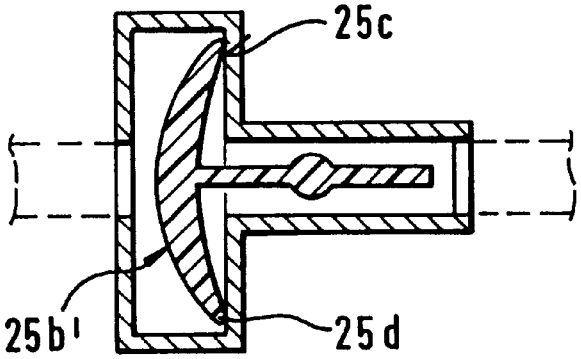

FIG. 1*a* shows a mushroom valve 25*b′* as a pressure equalization valve which is provided exclusively for the aeration of the fuel tank 16. As already described, the mushroom valve 25*b′* is provided with an arcuate elastic sealing edge 25*d* which seawhich seals, in the case of a drop in pressure from the pressure line 24 line 24 to the intake channel 13. In the case of a drop in pressure pressure in the opposite direction, the sealing edge 25*d* is lifted away from the valve seat 25*c.* This mushroom valve 25*b′* has a fixing pin, has a fixing pin, which is approximately perpendicular and central in relation to the plane of the valve seat and which has a bead-like thickening at a distance from a valve head with its sealing edge 25*d.*

Figure 1B:
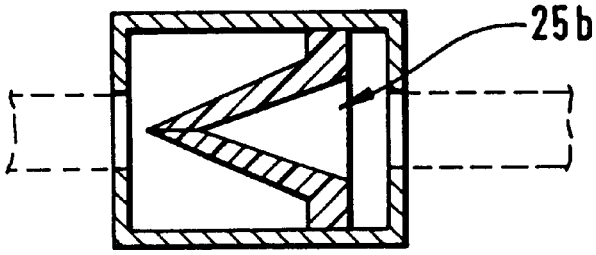

The embodiment in FIG. 1*b* shows that a duckbill valve 25*b* can be provided as a pressure equalization valve in the venting line instead of a mushroom valve.

Figure 1C:
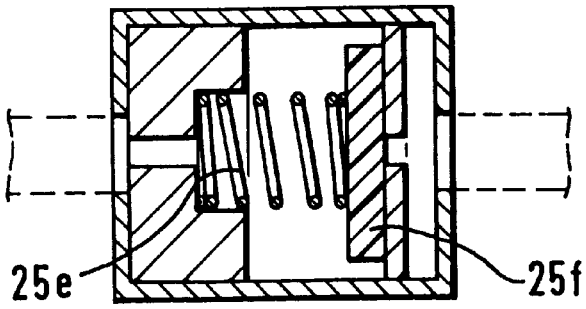

FIG. 1*c* shows an embodiment of the pressure equalization valve with a membrane 25*f* biased by a spring 25*e.* The membrane 25*f* serves as a closing element.

The invention described above achieves a tank ventilation which does not require an additional connection to the fuel tank 16 and therefore results in a design which is more favorable and more flexible in terms of both function and cost. In addition to the aeration valve, a venting valve can be provided which remains closed during normal operation so that neither gases containing fuel nor liquid fuel can escape if the tool is operated correctly.

It is understood that the foregoing description is that of the preferred embodiments of the invention and that various changes and modifications may be made thereto without departing from the spirit and scope of the invention as defined in the appended claims.

What is claimed is:

1. A pressure equalization system for a fuel tank of an internal combustion engine for a portable handheld work tool such as a cutoff machine, motor-driven chain saw, brushcutter and the like, the pressure equalization system comprising:

a carburetor for supplying an air/fuel mixture to said engine;

an intake air filter having a clean air side;

said carburetor including a control membrane delimiting a control chamber filled with fuel and an intake channel into which fuel from said control chamber is drawn by suction;

said intake channel being connected to said clean air side of said intake air filter;

a fuel tank;

a feed valve controlled by said control membrane for supplying fuel from said fuel tank to said control chamber; and, a start-assist device for flooding said control chamber before starting said engine;

a suction line connecting said start-assist device to said control chamber;

a return line connecting said start-assist device to said fuel tank;

a pressure equalization valve connected to said return line; and, said pressure equalization valve being operatively connected to said intake channel.

2. The pressure equalization system of claim 1, said pressure equalization valve having an end facing away from said return line; and, said end of said pressure equalization valve being connected to said clean air side of said intake air filter.

3. The pressure equalization system of claim 2, said pressure equalization valve being configured as an aerating valve opening in the direction toward said return line.

4. The pressure equalization system of claim 3, said pressure equalization valve being additionally configured as a venting valve open in the opposite direction.

5. The pressure equalization system of claim 4, said aerating valve being configured as a duckbill valve.

6. The pressure equalization system of claim 4, said aerating valve being configured as a mushroom valve.

7. The pressure equalization system of claim 4, said aerating valve being configured as a spring-biased membrane valve.

8. The pressure equalization system of claim 4, said pressure equalization valve being configured as a combination valve comprising a duckbill valve and a mushroom valve.

9. The pressure equalization system of claim 8, said mushroom valve having an axial shaft; and, said duckbill valve being integrated into said axial shaft of said mushroom valve.

10. The pressure equalization system of claim 7, said mushroom valve having an elastically deformable sealing edge.

11. The pressure equalization system of claim 9, said fuel tank including a wall, a fill opening in said wall and a fuel cap for said fill opening; and, said return line being connected to said fuel tank on said wall thereof.

* * * * *

UNITED STATES PATENT AND TRADEMARK OFFICE

CERTIFICATE OF CORRECTION

PATENT NO. : 6,227,176 B1
DATED : May 8, 2001
INVENTOR(S) : Heinz Hettmann

It is certified that error appears in the above-identified patent and that said Letters Patent is hereby corrected as shown below:

Column 4,
Line 51, delete "seawhich".
Line 52, delete "line 24" (second occurrence).
Line 53, delete "pressure (second occurrence).
Line 56, delete "has a fixing pin,".

Signed and Sealed this

Twenty-eighth Day of August, 2001

*Attest:*

Nicholas P. Godici

*Attesting Officer*

NICHOLAS P. GODICI
*Acting Director of the United States Patent and Trademark Office*